United States Patent [19]

Saito

[11] 4,401,881

[45] Aug. 30, 1983

[54] TWO-DIMENSIONAL THERMAL HEAD

[75] Inventor: Tamio Saito, Oume, Japan

[73] Assignee: Tokyo Shibaura Denki Kabushiki Kaisha, Kawasaki, Japan

[21] Appl. No.: 244,796

[22] Filed: Mar. 17, 1981

[30] Foreign Application Priority Data

Mar. 21, 1980 [JP] Japan ..... 55-34760
Mar. 26, 1980 [JP] Japan ..... 55-38647
Jul. 18, 1980 [JP] Japan ..... 55-98561

[51] Int. Cl.[3] ..... H05B 1/00

[52] U.S. Cl. ..... 219/216; 219/543; 338/309; 345/76 PH

[58] Field of Search ..... 219/216, 522, 543, 538, 219/553; 338/22 R, 308, 309; 346/76 R, 76 PH

[56] References Cited

U.S. PATENT DOCUMENTS 2,781,526 12/1973 Damron ..... 219/538
3,903,393 9/1975 Stapleton et al. ..... 219/216
3,984,844 10/1976 Tarmo et al. ..... 219/216 X
4,048,470 9/1977 Shindo et al. ..... 219/216
4,055,743 10/1977 Conta ..... 219/216

FOREIGN PATENT DOCUMENTS 21833 7/1981 European Pat. Off. .
32087 7/1981 European Pat. Off. .

*Primary Examiner*—Volodymyr Y. Mayewsky
*Attorney, Agent, or Firm*—Oblon, Fisher, Spivak, McClelland & Maier

[57] ABSTRACT

In a thermal head, a resistive member forming a two-dimensional pattern to be printed on a thermosensitive recording paper is fixed on plural pairs of first and second electrodes. The first electrodes extend on a surface and are commonly connected at one end to be impressed with a first voltage. The second electrodes extend on the same surface that the first electrodes lie and are commonly connected at one end to be impressed with a second voltage lower than the first voltage. The first and second electrodes are arranged in an interdigitate fashion.

13 Claims, 17 Drawing Figures

TWO-DIMENSIONAL THERMAL HEAD

The present invention relates to thermal head for printing a two-dimensional pattern on a thermosensitive recording medium and, more particularly, a thermal head for thermally printing a two-dimensional pattern on the recording medium at a fixed location without feeding the recording medium.

A thermally printing head (referred to as a thermal head) used in a facsimile communication field thermally prints two-dimensional patterns on a thermosensitive recording paper transferred relative to the printing head containing heating resistors laterally arranged in series. On the other hand, for printing a name of station on a ticket or a commutation ticket by means of a thermal head, it is required to simultaneously punch it and print the station name of the same. In this case, therefore, a two-dimensional pattern such as the station name must be printed on the ticket without transferring the ticket. Let us consider a case where a Chinese character is printed on a thermosensitive recording medium by using a thermal head with a matrix of 36×36 printing dots. In this case, resistive elements of 1296 must be arranged with separate leads connected to the resistive elements. Therefore, the thermal head of this type is expensive. Additionally, the thermal head of this type requires memories to drive the resistive elements of which the number is the same as that of the resistive elements and a circuit for controlling the read and write operations of the memories. Use of those additional elements makes the thermal head complicated and extremely expensive.

To solve the defects as mentioned above, there has been proposed a thermal head having a configuration as shown in cross section in FIG. 1. In FIG. 1, reference numeral 1 designates a substrate of ceramic material; 2 a thick film resistor; 3 electrodes for supplying heating power to the thick film resistor 2; 4 an overcoating glass film; 5 an epoxy resin layer, for example, for bonding the glass film 4 to a printing plate 6. The printing plate 6 is made of a stainless material bearing a printing pattern 7 which is formed by machining or etching the surface of the printing plate 6 in accordance with a configuration of the printing pattern 7 such as a character. In FIG. 1, when voltage is applied between the electrodes 3 and 3, the thermal energy is transmitted to the substrate 1 and also to the printing pattern 7 through overcoating glass film 4, the epoxy resin layer 5, and the printing plate 6. As a result, the printing pattern 7 is heated to a necessary temperature to thermally print the pattern 7 on a thermosensitive paper (not shown). Since the thermal conductivity of the ceramic substrate 1 is higher than that of the bonding layer (epoxy resin layer) 5 or the glass film 4, the thermal energy generated of 50% or more is transferred to the ceramic substrate 1. A thermal capacity of the printing plate 6 including the printing pattern 7 is large. Because of this, a time taken for printing is 1 to 3 seconds and a satisfactory picture quality can not be obtained. When the thermal head of this type is applied for the ticket printing as mentioned above, a number of ticket vendors for a fixed number of passengers is increased.

There has been another thermal head with a structure as shown in FIG. 2. In FIG. 2, numeral 8 designates a substrate; 10*a* common electrode; 10*b* a signal supply to electrodes 9; and heating resistive members each corresponding to a signal supply electrode. As shown, the heating resistive members 9 are shaped like a printing pattern. The common electrode 10*a* is disposed enclosing the respective resistive member of the printing pattern which include signal supply electrodes 10*b*, respectively. Each heating resistive member 9 is heated by applying a first voltage to the common electrode 10*a* and a second voltage to the corresponding signal supply electrode 10*b*. As described above, the signal supply electrodes are provided in the respective resistive members, so that it is possible to print a plurality of patterns by selectively driving the signal supply electrodes 10*b*. As described above, the thermal head with such a construction forms a print pattern by the heating resistive member per se, so that the printing speed is fast and the printing quality is improved compared with the conventional one.

The thermal head as mentioned above has a construction that the common electrode extends enclosing the respective resistive members of the printing pattern and each resistive member includes the signal supply electrode. Therefore, if the printing pattern is complex as a Chinese character, an arrangement of both electrodes is extremely complicated and the short-circuitings among the electrodes frequently occur. The short between the electrodes directly leads to an inaccuracy of printing or an erroneous printing. Therefore, such a case should be avoided. To this end, the printing pattern must be limited to a relatively simple one.

Accordingly, an object of the present invention is to provide a thermal head with a sample construction which can provide a clear print at a quick printing speed and provide a high accuracy of printing even if the printing pattern is complex.

According to the present invention, there is provided an insulating substrate; a first electrode means including a plurality of first electrodes which are fixed on the insulating substrate and extend in parallel with each other, one end of each of the first electrodes being commonly connected to be supplied with a first voltage; a second electrode means including a plurality second electrodes which are fixed on the insulating substrate and extend in parallel with each other with interdigitate relation to the first electrodes, one end of each of the second electrodes being commonly connected to be supplied with a second voltage lower than the first voltage; and at least one resistive element fixed on a plurality of pairs of the first and second electrodes for forming a two-dimentional pattern to be thermally printed on a thermosensitive recording medium.

According to the present invention, any shape of a two-dimensional pattern, for example, a Chinese character, may clearly been printed for short time without feeding a thermosenstive recording medium to the termal head. Further, the thermal head of the invention is very simple in construction.

Other objects and features of the present invention will be better understood from the following description taken in connection with the accompanying drawings, in which.

Figure 8A:
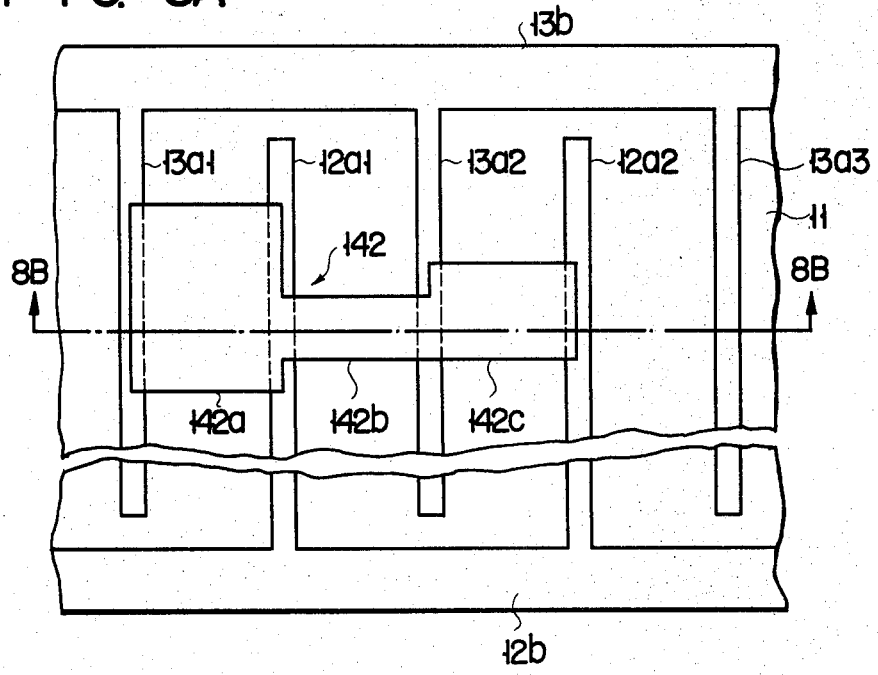
Figure 8B:
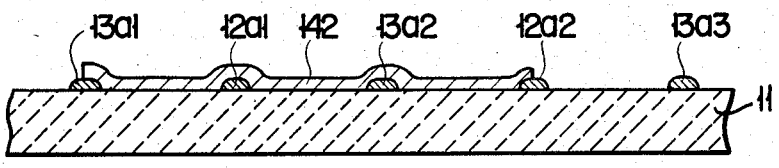
Figure 9A:
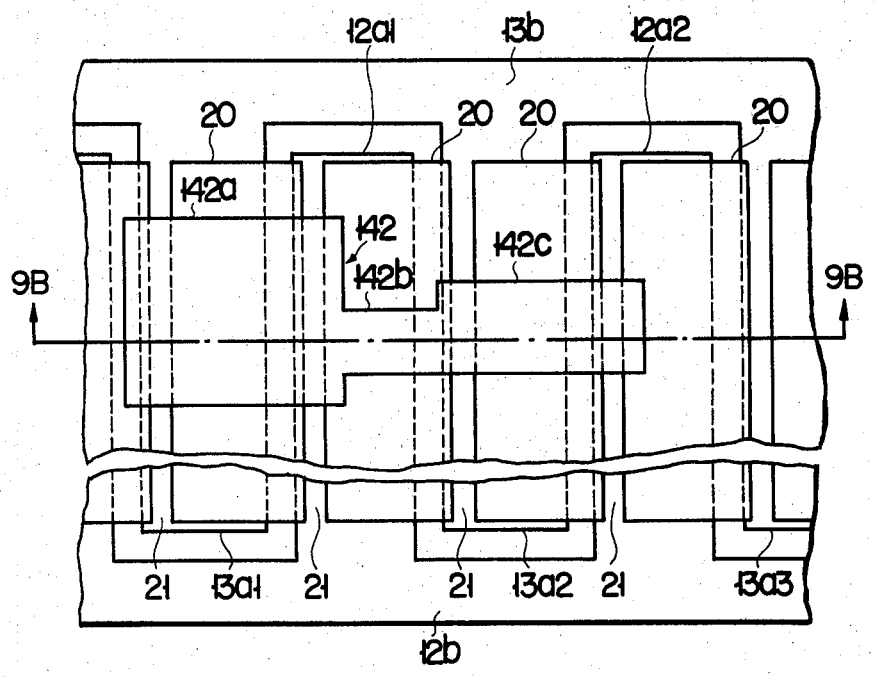
Figure 9B:
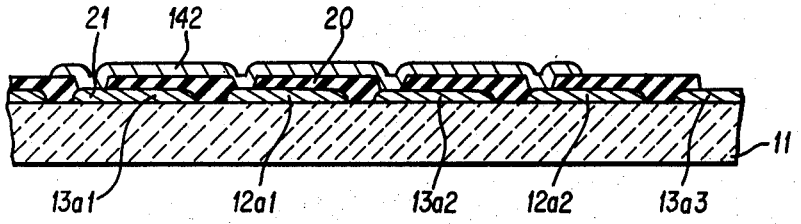
Figure 10A:
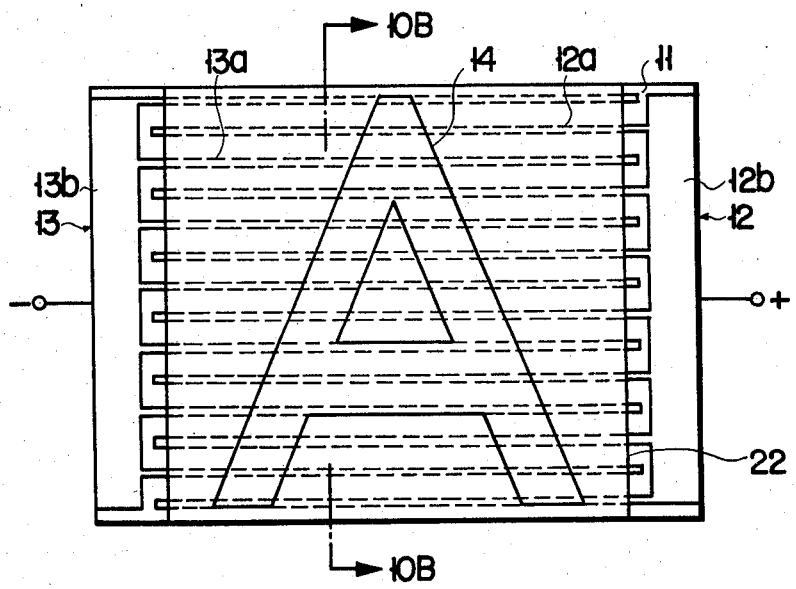
Figure 10B:
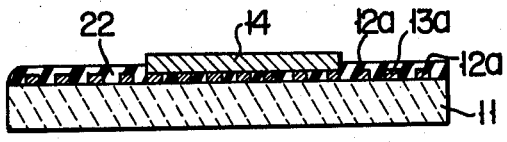

FIGS. 8A and 8B, respectively, show a view of a part of a thermal head, for explaining a relationship between voltage drops of the first and second electrodes and a configuration of the thermal head, FIG. 8A being a plan view and FIG. 8B being a cross sectional view taken on line 8B—8B in FIG. 8A;

FIGS. 9A and 9B, respectively, show a view of a part of thermal head of a fourth embodiment according to the present invention, FIG. 9A being plan view and FIG. 9B being a cross sectional view taken on line 9B—9B in FIG. 9A; and FIGS. 10A and 10B, respectively, show a view of a part of a thermal head of a fifth embodiment according to the present invention, FIG. 10A being a plan view and FIG. 10B a cross sectional view taken on line 10B—10B in FIG. 10A.

Figure 3:
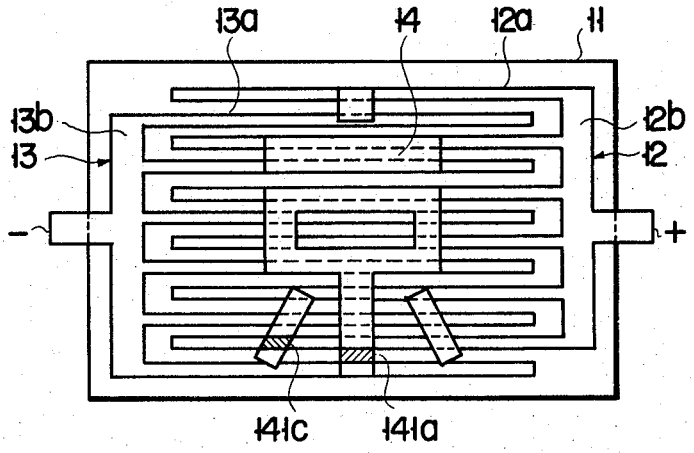
FIG. 3 is a plan view of a first embodiment of a thermal head according to the present invention.

In FIG. 3 illustrating a first embodiment of the present invention, first and second electrode structures 12 and 13 are fixed onto a ceramic substrate 11. The first electrode structure 12 includes a plurality of first linearly extending electrodes 12*a* commonly connected at one end to a common connection member 12*b* to which a positive voltage is applied. The second electrode structure 13 includes a plurality of second linearly extending electrodes 13*b* commonly connected at one end to another common connection member 13*b* to which a negative voltage is applied. The first and second electrodes 12*a* and 13*a* are arranged in an interdigitated fashion. Resistive members arranged to form a pattern 14 to be printed on a thermosensitive paper (not shown) which represents a Chinese character "KYO" in the present embodiment, are fixed on the interdigitated first and second electrodes. When the pattern 14 is formed by a thick film, for example, the material for the first and second electrode structures 12 and 13 must be the one capable of keeping its proper function as required even under the firing process of a gold thick film paste, for example. When the pattern 14 is formed by a thin film, the electrode structures may be made by a fired thick film conductor or a mixed conductor of Mo and Mn or a W conductor formed on the substrate 11. The electrode structures may be formed by selectively etching a conductive film which is formed over a ceramic insulating layer by evaporating, sputtering or chemical plating process. More specifically, a metal having large oxidation free energy, such as Ti, Cr and V, is placed as adhesive on the ceramic substrate 11. Then, a metal with low oxidation energy such Au or Ag is layered on the adhesive layer. Then, the layer is subjected to proper exposure and etching processes, thereby to form the first and second electrode structures. When it is necessary to prevent diffusion of the adhesive, a diffusion preventing layer such as Pd or Ni is provided between the adhesive layer and the electrode forming layer. The electrode forming layer which can withstand the firing process, such as a Cr-Au alloy layer, a Ti-Ni-Au alloy layer or a Ti-Pd-Au alloy layer, is formed closely in contact with the diffusion preventive layer. Then, the electrode forming layer is properly subjected to the exposure and etching processes, while only the necessary part for forming first and second electrode structures are left. The pattern 14 may be made by firing a thick film paste made of oxide ruthenium $RuO_2$ or the like or may be made from a thin film resistive member of tantalum silicate $TaSiO_2$ or the like. One of the methods to fix the pattern 14 to the first and second electrodes follows. In case where the thick film is employed for the first and second electrodes 12*a* and 13*a*, and the resistor or pattern 14, those may be bonded to each other by the firing. When the thin film is used for the first and second electrodes, the resistor or pattern 14 may be bonded to the electrodes 12*a* and 13*a* by the sputtering process. In an example of forming the pattern 14, an insulating thick film, such as boron silicate glass, is printed over an entire surface of the electrodes 12*a* and 13*a*, and then liquid photosensitive resin is deposited over the printed layer. After the photosensitive resin deposited is dried, a photo sensitive dry film is laminated on the dried layer. Then, the laminated layer is exposed for development with a mask corresponding in configuration to the pattern 14. The dried film corresponding to the pattern 14, the photosensitive resin, and the boron silicate glass are removed in the step following the development process. In the next step, thick film paste is rubbed into the pattern 14 formed and the laminate layer is peeled therefrom. Then, the thick film paste rubbed into the pattern and the boron silicate glass are simultaneously fired. Through the firing process, the resistor forming the pattern 14 and the electrodes are fired into a unitary body. During the firing process, the photosensitive region is decomposited and removed.

Figure 4A:
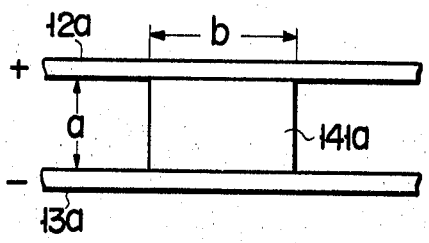
FIGS. 4A to 4C are plan views of pattern elements or resistive elements forming a printing pattern for analyzing a relationship between a heat amount radiated from the unit area of a pattern element and a surface configuration of the pattern element.

The principle of heat generation in the pattern 14 in FIG. 3 will be described referring to FIGS. 4A and 4C. FIG. 4A shows a plan view of a portion 141*a* of the pattern 14 in FIG. 3. FIG. 4C is a plan view of a portion 141*c* of the pattern 14. A portion 141*b* shown in FIG. 14B is not illustrated in FIG. 3. In FIG. 4A, the surface of the resistor 141*a* is a rectangular with sides a and b where a is the interval between the first and second electrodes 12*a* and 13*a* and b is the width of the resistor 141*a*. Let us calculate a resistance R of the resistor 141*a* in the current passage direction and a heat amount $\Delta W$ radiated from per unit area of the resistor 141*a*. In this case, the thickness (the size of the resistor in a direction orthogonal to the paper surface of the drawing) of the resistor 141*a* is assumed to be uniform. A resistance R of the whole resistor 141*a* (a resistance between the electrodes 12*a* and 13*a*) is expressed by $R=\rho\times a/b$ where $\rho$ is a sheet resistivity (a resistance measured in the direction a of an area expressed by a product of unit length of the width b and the thickness of the resistor 141*a*). The heat amount W radiated from the resistor 141*a* is expressed by $W=V^2/R$ where V is a potential difference between the electrodes 12*a* and 13*a*. The equation of W is rewritten into $W=bV^2/a\rho$. The heat amount $\Delta W$ radiated from per unit area on the surface of the resistor 141*a* is given by $\Delta W=W/ab=V^2/\rho a^2$. This equation indicates that $\Delta W$ is not related to the width b of the resistor. This fact is desirable in forming the pattern.

Figure 4B:
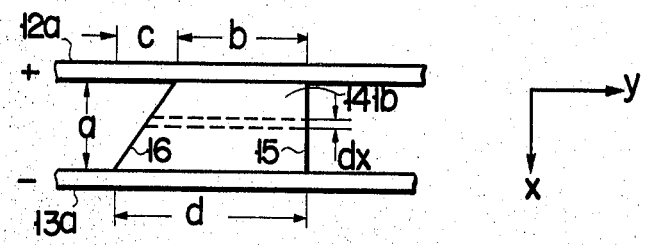
Figure 4C:
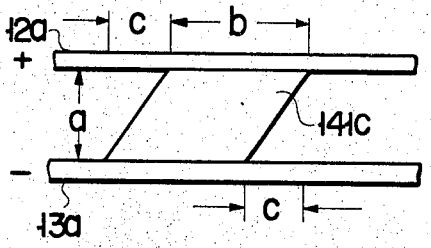

The resistor 141*b* shown in FIG. 4B is trapezoidal having two parallel sides d and b, a side 15 orthogonal to the sides d and b, and a slanted side 16. A y axis is applied to the extending direction of the electrode 12*a*. An x axis is applied to the interval a between the electrodes. The resistor 141*b* has a width w at a given point on the x axis. The width w of the resistor 141*b* is expressed by $w=b+(c/a)x$ where $c=d-b$. dR of the resistance in the resistor portion with a width dx normal to the paper surface of the drawing, is expressed by $$dR = \rho \frac{dx}{b + \frac{c}{a} x}.$$

The resistance R of the resistor 141*b* in the direction x is given $$R = \int_0^a \rho \frac{dx}{b + \frac{c}{a} x} = \frac{\rho a}{c} \ln\left(1 + \frac{c}{b}\right) \quad (1)$$

The power consumption of the whole resistor 141*b* is given by an equation (2)

$$W = \frac{V^2}{R} = \frac{c}{\rho a} \frac{V^2}{\ln\left(1 + \frac{c}{b}\right)} \quad (2)$$

The heat amount ΔW rediated from a unit area of the upper surface of the resistor 141*b* is given by an equation (3)

$$\Delta W = \frac{W}{S} = \frac{cV^2}{\rho a\left(ab + \frac{ac}{2}\right) \ln\left(1 + \frac{c}{b}\right)} \quad (3)$$

where S is the upper surface area of the resistor 141*b*. If $c/b \approx 0$, the equation (3) may be approximated by $$\Delta W \approx \frac{V^2}{\rho a^2\left(1 + \frac{c}{2b}\right)}.$$

When $c=b/2$, the heat amount ΔW radiated from the unit area of the resistor 141*b* is merely about 25% less than the heat amount radiated from unit area of the resistor 141*a*. As in the case of the resistor 141*b* shown in FIG. 4B, the heat amount ΔW radiated from unit area of the resistor 141*c* shown in FIG. 4C may be calculated. In this case, the ΔW is slightly less than that in the case of FIG. 4B.

As seen from the above discussion, when the thickness of the resistor 141*a* is uniform and the surface of it is rectangular with two sides perpendicular to the electrodes 12*a* and 13*a*, the surface heat radiating density of the resistor is uniform and the heat amount radiated from unit area is at maximum. It was confirmed, however, that even the configuration 141*b* or 141*c* of the resistors is applicable for the present invention if the ratio c/b is properly selected.

Figure 5:
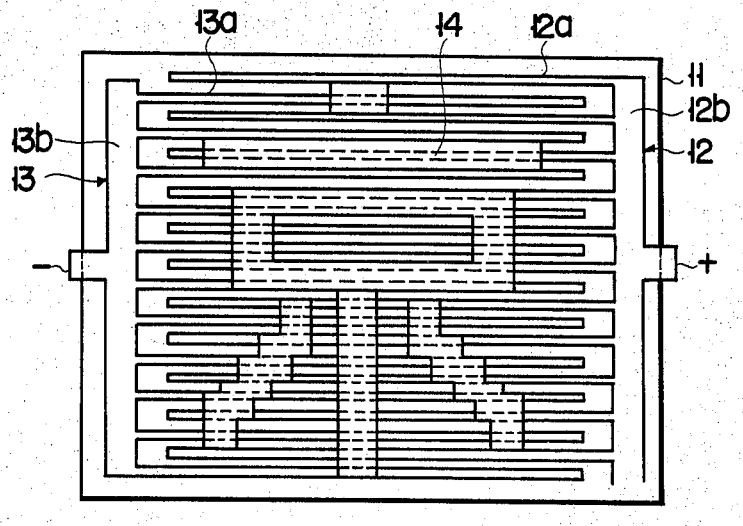
FIG. 5 shows a plan view of a second embodiment of a thermal head according to the present invention.

Turning now to FIG. 5, there is shown a plan view of a second embodiment of a thermal head according to the present invention. In the figure, like numerals in FIG. 3 are used for designating like portions. In the present embodiment, the pattern 14 is formed by properly combining a plurality of rectangular resistive elements with two sides orthogonal to the electrodes 12*a* and 13*a*. The heat radiating density on the surface of the pattern 14 is uniform, thus ensuring a uniform concentration printing.

Figure 6A:
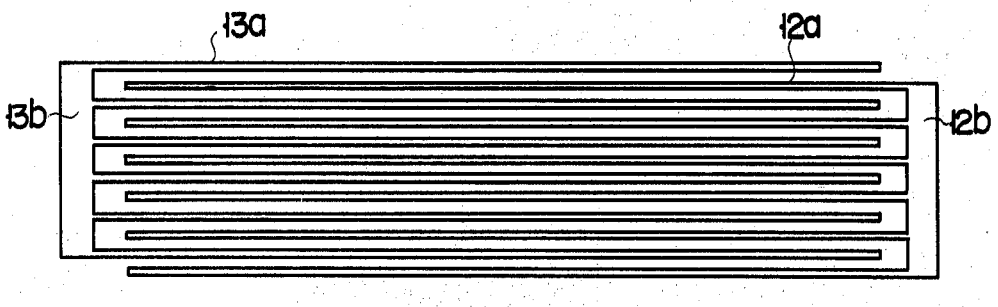
FIGS. 6A to 6C are plan views of some modifications of an arrangement of first and second electrodes, respectively.
Figure 6B:
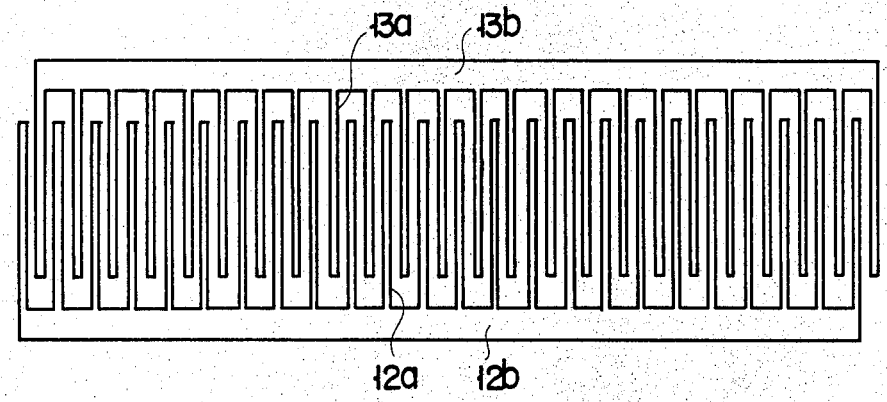
Figure 6C:
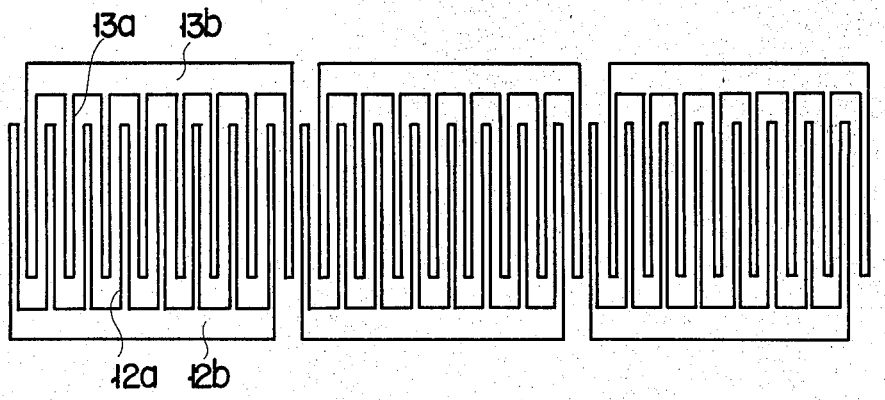

For fabricating thermal heads with the same areas, the voltage drop of the electrodes 12*a* and 13*a* must be taken into account. FIGS. 6A to 6C show some modifications of the electrode arrangement. FIG. 6A shows the electrode arrangement with long electrodes 12*a* and 12*b*. In forming a pattern, the voltage drop of those electrodes must be considered. The electrode arrangement shown in FIG. 6B with short electrodes is adaptable for a case where the power consumption of the pattern is large. The electrode arrangement shown in FIG. 6C is suitable for a case where power supplied to the pattern is large and therefore there is required some limit of a power source capacity for driving the pattern.

Figure 7:
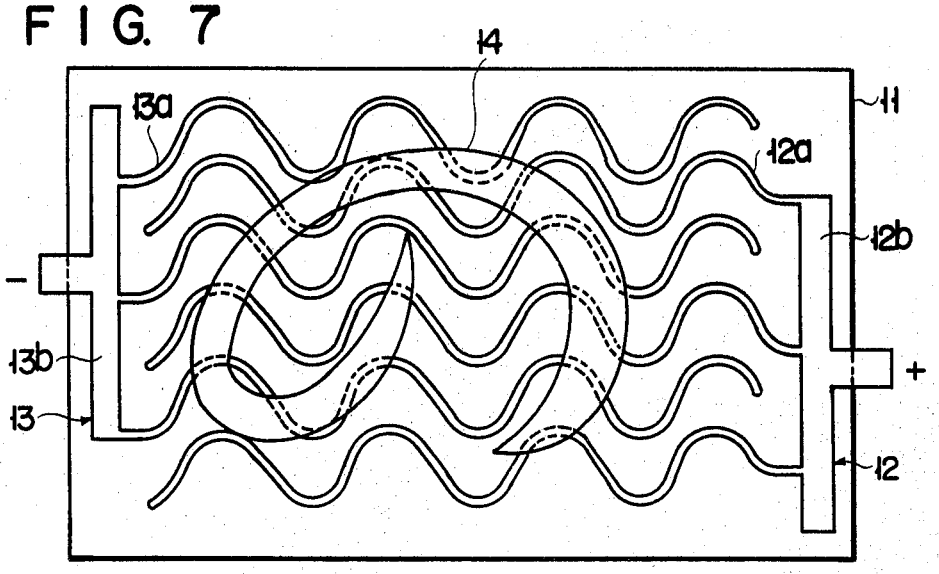
FIG. 7 shows a plan view of a third embodiment of a thermal head according to the present invention.

FIG. 7 shows a plan view of a third embodiment of a thermal head according to the present invention. In the present embodiment, electrodes 12*a* and 13*a* have wave shapes arranged in parallel with interdigtate form. This type of the electrode arrangement is suitably employed for some configuration of the pattern.

In the embodiment shown in FIG. 5, the heat radiating density over the entire surface of the pattern 14 is made uniform to render the printed pattern to have uniform concentration by making the surface configuration of each resistor element of the pattern 14 rectangular. If the nonuniformity of the concentraction in the printed pattern arising from the voltage drops in the electrodes 12*a* and 13*a* per se is prevented, the printing concentration uniformity of the printed pattern is further improved. Let us consider the nonuniformity of the printing concentration of the printed pattern due to the voltage drops of the electrodes, referring to FIGS. 8A and 8B. It is assumed that the pattern elements, or resistor elements, 142*a*, 142*b*, and 142*c* extend over electrodes 13*a*1 and 12*a*1, 12*a*1 and 13*a*2, and 13*a*2 and 12*a*2, respectively. In this arrangement, the width (length as viewed in a direction along the electrodes of the pattern element 142*a*) is large. Therefore, the voltage drop of each of electrodes 13*a*1 and 12*a*1 is large. Since the pattern element 142*b* has a short width, the current flowing through the electrode 13*a*2 is small, so that a voltage drop of the electrode 13*a* is small. When the widths 142*a*, 142*b* and 142*c* of the pattern elements are different from one another as mentioned above, the voltage applied to the ends of the pattern elements are different, causing the printed pattern to be nonuniform in concentration. This problem may be solved by making thick the thickness of the electrode (the size of the electrode normal to the paper surface) or to make large the width of the electrode (size of the electrode as viewed in a direction normal to the longitudinal direction of the electrode). When the thickness of the electrode is made thick, however, the portion of the pattern element located between each electrode pair is pressed toward the substrate 11 as shown in FIG. 8B, so that the entire pattern of the pattern 142 incompletely contacts with the thermosensitive paper, resulting in an uneven printing concentration of the printed pattern. When the width of each electrode is large, the contact area between the pattern element and the electrodes is large. As no heat is developed at the contact area, the quality of the printed pattern is degraded.

FIGS. 9A and 9B cooperatively show a fourth embodiment of a thermal head according to the present invention which can solve the above-mentioned problem. In FIGS. 9A and 9B, like numerals are used for designating like portions in FIGS. 8A and 8B. Major differences of the present embodiment from the embodiment of FIGS. 8A and 8B are: the widths of the electrodes are wide; each electrode except an exposed portion 21 is covered with an insulating layer 20; the pattern 142 is disposed on the insulating layer 20 and the exposed surface 21 whereby the electrodes and the pattern are electrically connected through the exposed portion 21.

When a voltage is applied between the common connection members 12*b* and 13*b*, current flows into the pattern elements through the exposed portions 21, with the result that the respective resistor elements are heated to make a print of the pattern 142 on the thermosensitive paper (not shown). Note here that, since the pattern 142 is electrically connected to the electrodes only through the exposed portions 21, non-heated portions in the pattern are only those portions contacting the exposed portions 21. Therefore, even if the width of the electrode is made large, the heating area of the pattern 142 is not reduced. Thus, since the voltage drops in the electrodes can be reduced by making large the widths of the electrodes, the present embodiment successfully overcomes the above-mentioned uneven printing concentration of the printed pattern due to the voltage drops of the electrodes. Additionally, the problem of the depression of the pattern surface caused by the short widths of the electrodes may be solved by using the electrodes having wide widths.

As described above, the thermal head of the present invention has a construction that the pattern 14 is physically fixed to the plurality of the electrodes with an electrical connection therebetween and the pattern 14 is heated through the electrodes. Therefore, when temperature of the pattern 14 rises, temperature of the electrode portions adjacent to the edges of the pattern also rises, so that a temperature difference between the pattern and the electrodes is made small. As a result, the pattern printed is indistinct at the edge portions.

A fifth embodiment of a thermal head according to the present invention shown in FIGS. 10A and 10B successfully solves this indistinct problem. Also in the present embodiment, like portions of the FIG. 5 embodiment are designated by like numerals for simplicity of explanation. In the embodiment in FIG. 10A, a pattern 14 to be printed is an alphabetical letter "A". The exposed portions of the electrodes 12*a* and 13*a* having no pattern formed thereon are covered with a thermal insulating layer 22, for example, an insulating thick film. Therefore, temperature inclination at the edge portions of the pattern is steep, thereby to eliminate the undistinct print of the pattern at the same portions. The thermal insulating layer 22 may cover the common electrode members 12*b* and 13*b* in addition to the above portions or only the electrodes 12*a* and 13*a* as illustrated.

Figure 1:
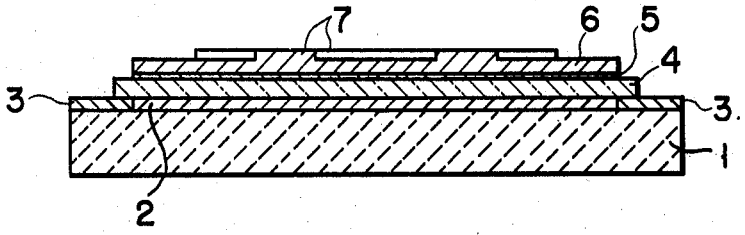
FIG. 1 PRIOR ART
FIG. 1 is a cross sectional view of a conventional thermal head.
Figure 2:
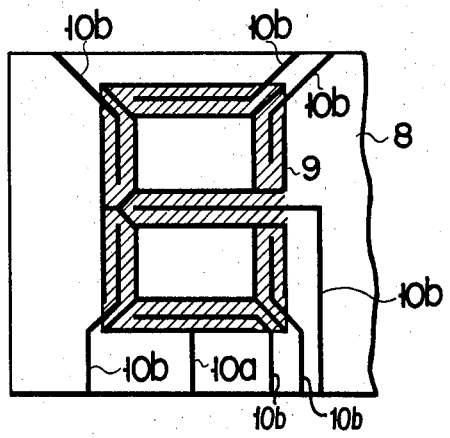
FIG. 2 PRIOR ART
FIG. 2 is a plan view of another conventional thermal head.

As described above, the thermal head of the present invention is provided with plural pairs of first and second electrodes interdigitally coupled on the same plane. A pattern to be printed is arranged on the electrode pairs. A single current source is merely connected between the common connection members of the first and second electrodes. Therefore, the structure of the thermal head is considerably simple. Further, heating power is directly applied from the first and second electrodes to the pattern elements. Therefore, a thermal response of the thermal head is excellent, so that the printing time is improved several times compared with the thermal head shown in FIG. 1. Moreover, in the thermal head, the first and second electrode structures are arranged on the same plane without superposing one upon another and the heating resistive members are arranged on the electrodes. This feature elminates the problem of short between the electrodes while allowing any shape of the heating resistive member to be formed.

What is claimed is:

1. A thermal head for thermally printing a two-dimensional pattern comprising:

an insulating substrate;

first electrode means including a plurality of first electrodes which are fixed on said insulating substrate and extend parallel with each other, one end of each of said first electrodes being commonly and electrically connected to be supplied with a first voltage.

second electrode means including a plurality of second electrodes which are fixed on said insulating substrate and extend parallel with each other in interdigitated relation to said first electrodes, one end of each of said second electrodes being commonly and electrically connected to be supplied with a second voltage lower than said first voltage; and at least one two-dimensional resistive pattern defining a configuration to be directly and thermally printed on a thermosensitive recording medium, and which is fixed on plural pairs of said first and second electrodes for being heated by the voltage difference between said first and second voltages.

2. A thermal head for thermally printing a two-dimensional pattern according to claim 1, wherein said two-dimensional resistive pattern includes at least one resistive element which is fixed on at least one pair of said first and second electrodes and has a constant thickness.

3. A thermal head for thermally printing a two-dimensional pattern according to claim 1, wherein said first and second electrodes extend rectilinearly.

4. A thermal head for thermally printing a two-dimensional pattern according to claim 1, wherein said first and second electrodes extend curvelinearly.

5. A thermal head for thermally printing a two-dimensional pattern according to claim 3, wherein said two-dimensional resistive pattern includes the combination of rectangular resistive elements each having edges orthogonal and parallel to said first and second electrodes.

6. A thermal head for thermally printing a two-dimensional pattern according to claim 3, wherein exposed area of each of said first and second electrodes is covered with an insulating layer except part of said exposed area, said resistive element forming said two-dimensional pattern is provided contacting with said insulating layer and said exposed parts of said first and second electrodes.

7. A thermal head for thermally printing a two-dimensional pattern, according to claim 6, wherein said exposed part of each of said first and second electrodes is disposed at a location apart from the centerline of said first or second electrode by a predetermined distance and extends in parallel with said center line.

8. A thermal head for thermally printing a two-dimensional pattern according to claim 1, wherein exposed areas of said first and second electrodes are covered with a thermal insulating film, except the regions of said exposed area on which said two-dimensional pattern is formed.

9. A thermal head for thermally printing a two-dimentional pattern according to claim 1, wherein said first and second electrodes are made of a mixed conductor of Mo(molybdenum) and Mn(manganese).

10. A thermal head for thermally printing a two-dimentional pattern according to claim 1, wherein said first and second electrodes are made of W(tungsten).

11. A thermal head for thermally printing a two-dimentional pattern according to claim 1, wherein said first and second electrodes are made of Cr(chromium)-Au(gold) alloy.

12. A thermal head for thermally printing a two-dementional pattern according to claim 1, wherein said first and second electrodes are made of Ti(titanium)-Ni(nickel)-Au(gold) alloy.

13. A thermal head for thermally printing a two-dimentional pattern according to claim 1, wherein said first and second electrodes are made of Ti(titanium)-Pd(palladium)-Au(gold) alloy.

* * * * *